US009194100B2

(12) United States Patent
Fix et al.

(10) Patent No.: US 9,194,100 B2
(45) Date of Patent: Nov. 24, 2015

(54) LIGHT GRID SYSTEM FOR ROPE MACHINERY

(71) Applicant: Caterpillar Global Mining LLC, Oak Creek, WI (US)

(72) Inventors: Russell A. Fix, Oak Creek, WI (US); James Onsager, Oak Creek, WI (US)

(73) Assignee: Caterpillar Global Mining LLC, Oak Creek, WI (US)

( * ) Notice: Subject to any disclaimer, the term of this patent is extended or adjusted under 35 U.S.C. 154(b) by 308 days.

(21) Appl. No.: 13/709,749

(22) Filed: Dec. 10, 2012

(65) Prior Publication Data

US 2014/0157634 A1 Jun. 12, 2014

(51) Int. Cl.

| | |
|---|---|
| ***B65H 77/00*** | (2006.01) |
| ***E02F 3/48*** | (2006.01) |
| ***B66D 1/50*** | (2006.01) |
| ***E02F 9/20*** | (2006.01) |
| ***E02F 9/26*** | (2006.01) |

(52) U.S. Cl.

CPC ... *E02F 3/48* (2013.01); *B66D 1/50* (2013.01); *E02F 9/2016* (2013.01); *E02F 9/264* (2013.01); *E02F 9/268* (2013.01); *Y10T 29/49117* (2015.01)

(58) Field of Classification Search

CPC ..... B65H 23/042; B66C 13/10; B66D 1/50; B66D 1/48; B66D 1/485; E05F 15/43; E05F 2015/436; E05F 2015/434; F16P 3/14; F16P 3/144

USPC ..... 242/413.3–413.8; 254/272, 274, 275

See application file for complete search history.

(56) References Cited

U.S. PATENT DOCUMENTS

| | | | | |
|---|---|---|---|---|
| 3,584,805 | A * | 6/1971 | Lee | 242/331.4 |
| 3,887,038 | A | 6/1975 | Buschbom et al. | |
| 4,124,340 | A * | 11/1978 | LaSpisa et al. | 425/135 |
| 4,305,513 | A | 12/1981 | Voelz | |
| 4,447,016 | A * | 5/1984 | Enberg et al. | 242/413.3 |
| 4,699,260 | A * | 10/1987 | Nieberding, Jr. | 192/134 |
| 4,996,541 | A * | 2/1991 | Mori et al. | 347/264 |
| 7,222,839 | B2 | 5/2007 | Taylor et al. | |
| 7,348,536 | B2 * | 3/2008 | Bockel et al. | 250/221 |
| 8,651,461 | B2 * | 2/2014 | Christensen et al. | 254/269 |
| 2006/0196119 | A1 * | 9/2006 | Hormann | 49/26 |
| 2010/0224843 | A1 * | 9/2010 | Christensen et al. | 254/271 |
| 2012/0085531 | A1 | 4/2012 | Leising et al. | |

FOREIGN PATENT DOCUMENTS

WO WO 2008/048561 4/2008

OTHER PUBLICATIONS

Excerpt from SICK catalog (pp. 1-10 and 124-130 of catalog), Sep. 1, 2011, full catalog available at https://www.mysick.com/saqqara/im0041829.pdf.*

* cited by examiner

*Primary Examiner* — Dean Kramer
*Assistant Examiner* — Mark Hageman

(57) ABSTRACT

A light grid system for rope machinery is provided. The light grid system includes one or more light grid assemblies, including one or more sensor frames configured to be coupled to one or more post assemblies and configured to mount adjacent to one or more rope drums. The light grid assemblies also include one or more sensors coupled to the sensor frames, at least a first sensor configured to emit one or more light beams, at least a second sensor configured to receive the light beams. The light beams are positionable a predetermined distance away from the ropes, and the light grid assemblies are configured to transmit a signal to a control module when the light beams are obstructed.

20 Claims, 6 Drawing Sheets

LIGHT GRID SYSTEM FOR ROPE MACHINERY

TECHNICAL FIELD

This disclosure relates to large rope machinery, and more particularly to a light grid system for large rope machinery.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

Dragline excavators typically have a bucket assembly that is controlled by wire ropes. Hoist ropes attach to the top of the bucket assembly and move the bucket vertically, while drag ropes attach to the back of the bucket assembly and move the bucket horizontally. Both drag ropes and hoist ropes are wrapped around a drum assembly, which pulls and releases the ropes as necessary to maneuver the bucket. As the ropes are pulled and released, one or more ropes may become slack (i.e. lose tension). The slack rope creates an unbalanced load for the drum assembly, often causing damage to the internal bearings of the drum assembly as the drums rotate. The slack rope may also cause the bucket to swing with limited control, damaging the bucket or other excavator components, or dumping the contents of the bucket. This slack rope condition may cause similar problems in rope shovels or other machinery utilizing wire ropes.

Typically, a single beam photometric transmitter/receiver module has been utilized to identify a slack rope condition within the drum assembly. The conventional module is positioned parallel to the drum rotation and configured to detect a slack rope condition prior to any major damage to surrounding components. However, conventional detection modules often do not detect the slack rope condition early enough to prevent damage. The conventional modules are often designed to rest in a position close to the top of the deck, rather than near the drum, which allows the modules to detect only the most severe slack rope conditions. Also, the conventional modules typically have only a single beam, and may not detect slack ropes that are out of the direct line of the single beam.

Conventional slack rope detection modules are also susceptible to false positives (i.e. the module indicates that a slack rope condition is present when the condition has not occurred). False positives result in inefficiencies necessitated by machine downtime to address the slack rope alert (e.g. operator alert, machine shutdown, etc.) produced by the detection module. Conventional detection modules are typically not adjustable, so that the module cannot be easily corrected in response to the false positives. Therefore, the detection module may continue to give false positives until the machine is removed from the field for service, resulting in additional machine downtime.

An example of another conventional slack rope detection module is found in U.S. patent application Ser. No. 13/231,114, filed Sep. 13, 2011, for "Cable Monitoring in Coiled Tubing." This application discloses a cable slack monitoring feature configured to detect an accumulation of cable slack in a portion of coiled tubing. The detection module may include one or more monitoring features configured to collect data related to cable slack and tension. A control system may then analyze the data, comparing it with empirical data to identify whether a slack condition has occurred. One problem with this type of detection module is that it may not detect the slack rope condition early enough to prevent damage. Also, this conventional detection module is susceptible to false positives and may not be easily corrected in response to the false positives.

SUMMARY

An embodiment of the present disclosure relates to a light grid system for rope machinery, the rope machinery including one or more rope drums having a center line, and one or more ropes wrapped around the rope drums, the ropes configured to maneuver a machinery component. The light grid system includes one or more light grid assemblies. The light grid assemblies include one or more sensor frames configured to be coupled to one or more post assemblies and configured to mount substantially perpendicular to the center line of one or more rope drums. The light grid assemblies also include one or more sensors coupled to one or more sensor frames, at least a first sensor configured to emit one or more light beams, and at least a second sensor configured to receive one or more light beams.

In this embodiment, the light beams are positionable a predetermined distance away from the ropes, and the light grid assemblies are configured to transmit a signal to a control module associated with the rope machinery when one or more light beams are obstructed.

Another embodiment of the present disclosure relates to a dragline excavator. The dragline excavator includes a bucket assembly, one or more rope drums having a center line, and one or more ropes wrapped around the rope drums. The ropes are configured to maneuver the bucket assembly. The dragline excavator also includes one or more light grid assemblies. The light grid assemblies include one or more sensor frames configured to be coupled to one or more post assemblies and mounted substantially perpendicular to the center line of the rope drums. The light grid assemblies also include one or more sensors coupled to one or more sensor frames, at least a first sensor configured to emit one or more light beams, and at least a second sensor configured to receive one or more light beams.

In this embodiment, the light beams are positionable a predetermined distance away from the ropes, and the light grid assemblies are configured to transmit a signal to a control module associated with the dragline excavator when one or more light beams are obstructed.

Another embodiment of the present disclosure relates to a method for installing a light grid system for rope machinery. The method includes providing a first set of light grid assemblies having a transmitter configured to emit a plurality of light beams, providing a second set of light grid assemblies having a receiver configured to receive the plurality of light beams from the transmitter, positioning the transmitter and the receiver to provide a light grid at a predetermined distance in relation to one or more rope drums, and providing a control module configured to initiate a response when one or more light beams are obstructed.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present application is not limited to the details or methodology set forth in the description or illustrated in the figures. It should also be understood that the terminology is for the purpose of description only and should not be regarded as limiting.

Figure 1:
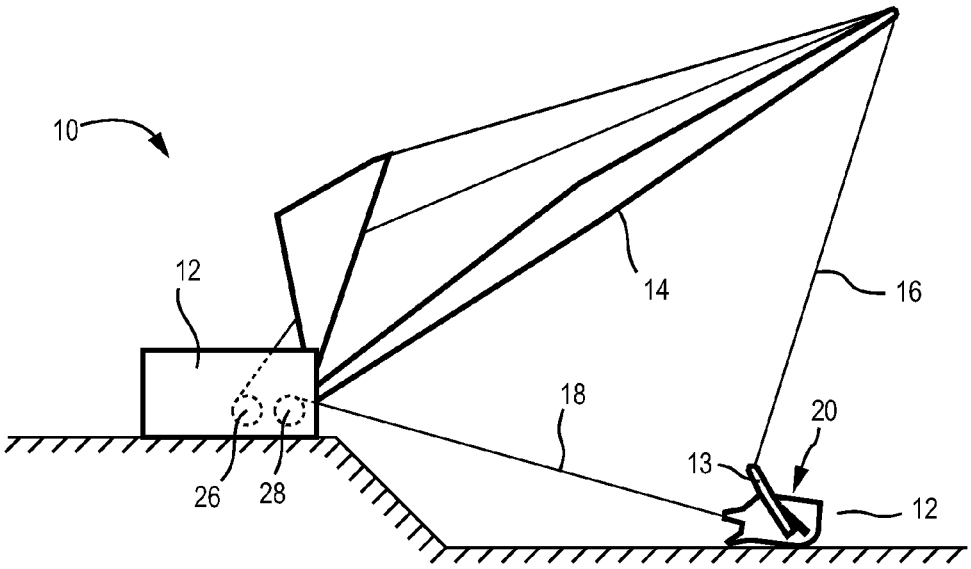
FIG. 1 is a schematic representation of a dragline excavator having a wire rope, according to an exemplary embodiment.

Referring to FIG. 1, a dragline excavator 10 having a dragline bucket assembly 20 is shown schematically, according to an exemplary embodiment. The dragline bucket assembly 20 includes a large bucket 12 configured to receive mining material. The dragline bucket assembly 20 also includes a coupler 13, which connects the bucket 12 to wire ropes 16 and 18. The bucket assembly 20 is suspended from a boom 14 by the hoist ropes 16. The hoist ropes 16 extend up from a hoist drum 26 to the boom 14, supporting the bucket assembly 20 from the boom 14. The hoist ropes 16 are configured to move the bucket 12 vertically. The drag ropes 18 extend out from a drag drum 28, extending substantially parallel to the ground and supporting the bucket assembly 20 from the base of the excavator 10. The drag ropes are configured to move the bucket 12 horizontally. The bucket 12 can be maneuvered by the coordinated motion of the drag ropes 18 and hoist ropes 16.

During operation, the bucket 12 is typically positioned above the material to be excavated. The bucket 12 is lowered and the drag ropes 18 are drawn, so that the bucket 12 is dragged along the surface of the material. The bucket 12 is lifted using the hoist ropes 16, then swung to the place where the material is to be dumped. Once the bucket 12 is positioned, the drag ropes 18 are released, causing the bucket 12 to tilt and empty.

Figure 2:
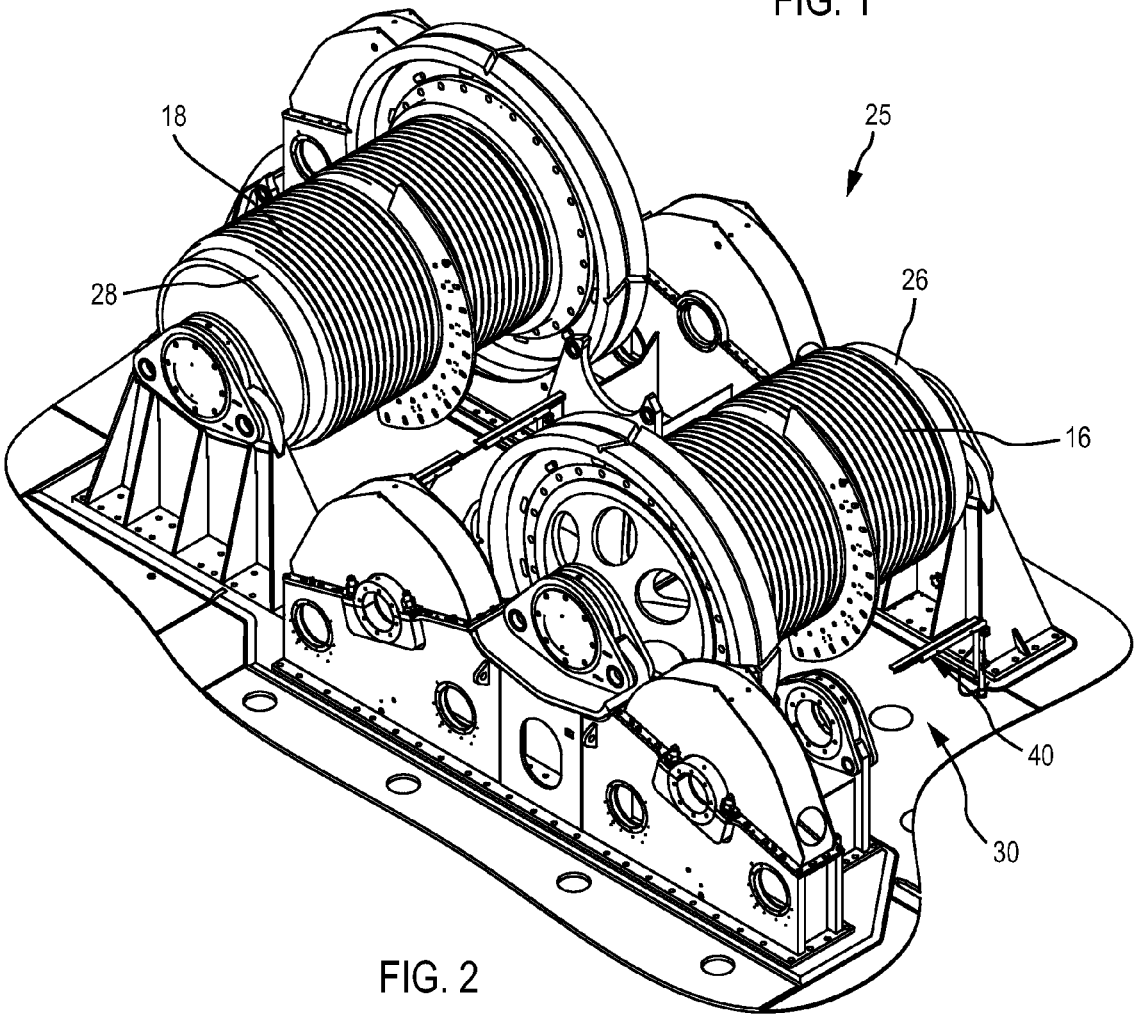
FIG. 2 is a perspective view of drum machinery for a dragline machine, including a through-beam light grid system, according to an exemplary embodiment.
Figure 3:
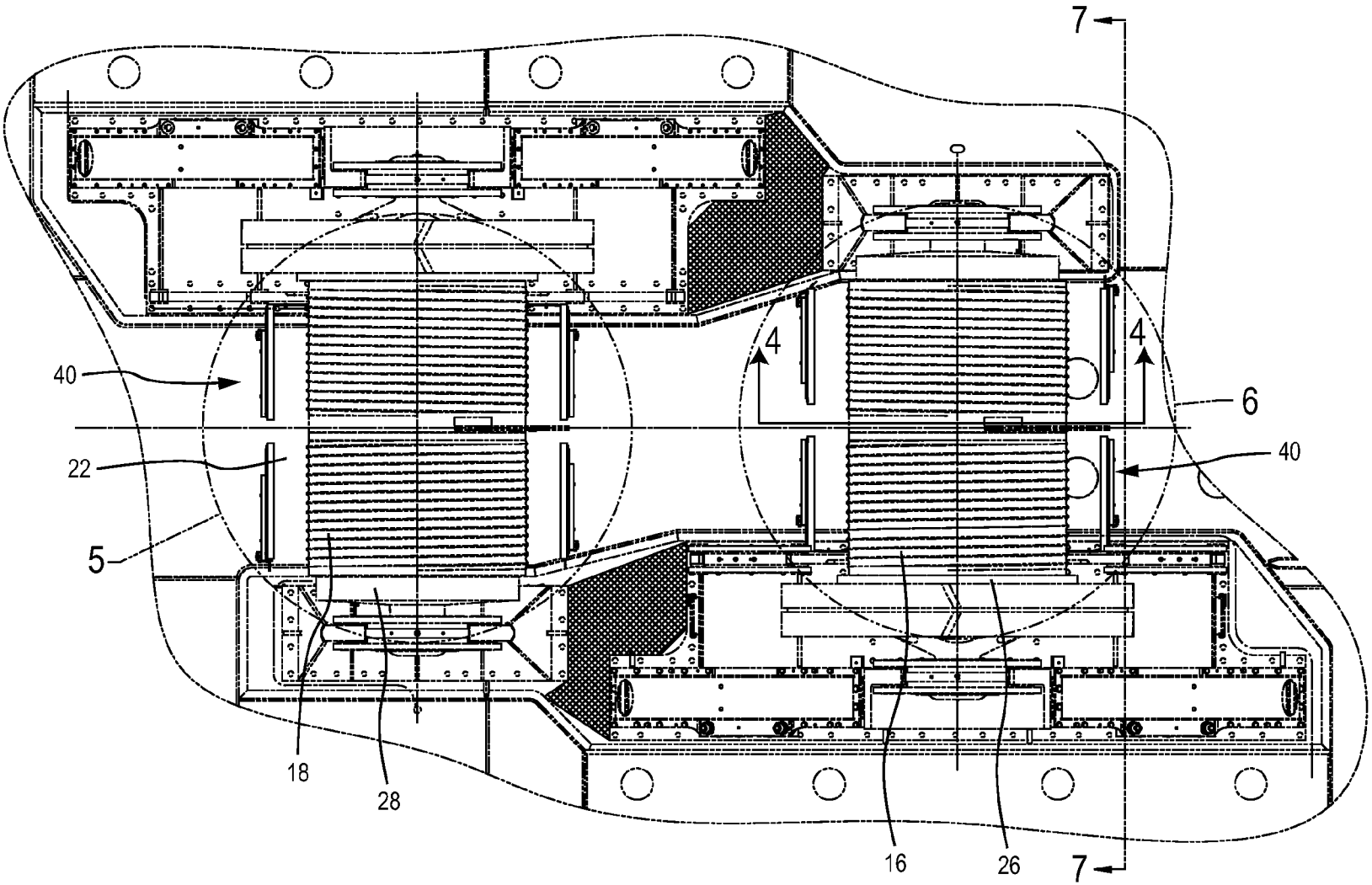
FIG. 3 is a top view of the drum machinery and through-beam light grid system of FIG. 2.

Referring now to FIGS. 2 and 3, a drum assembly 25 for a dragline excavator 10 (or other suitable equipment) is shown, including a light grid system 30. In exemplary embodiments, the drum assembly 25 includes the drag drum 28 and the hoist drum 26. The drag rope 18 is wound around the drag drum 28, and the hoist rope 16 is wound around the hoist drum 26. The drag rope 18 extends out from the drag drum 28, connecting the drag drum 28 to the back end of the bucket assembly 20. The hoist rope 16 extends substantially vertically from the drum assembly 25, connecting the hoist drum 26 to the top of the bucket assembly 20. The drums 26 and 28 are configured to rotate, pulling and letting the ropes 16 and 18 as necessary to maneuver the bucket 12.

As the drums 26 and 28 rotate, the ropes 16 and 18 may become slack (i.e. lose tension or otherwise lose contact with the drum), arching out and forming a space between the rope 16 or 18 and the drum 26 or 28. This slack rope condition (shown by way of example in FIG. 4) may create an unbalanced load for the drum 26 or 28. The unbalanced load rotating around the drum 26 or 28 at potentially high speeds (i.e. up to 35 rpm) may cause damage to the internal bearings (not shown) on the drum assembly 25. The slack rope condition may also cause damage to the boom 14. For instance, when the slack section of rope 16 or 18 is encountered by the drum 26 or 28, the bucket 12 may swing with limited control, crashing into the boom 14 or other components of the excavator 10. In addition, as the slack portion of the rope 16 or 18 is pulled over the drum 26 or 28, the rope 16 or 18 may suddenly become tight, which may damage the bucket 12 or dump its contents by causing the bucket 12 to stop abruptly, move with a sudden "jerk", or otherwise move in an undesired manner.

Still referring to FIGS. 2 and 3, the drum assembly 25 further includes a light grid system 30. The light grid system 30 is intended to identify a slack rope condition in the drum assembly 25. The light grid system 30 includes light grid assemblies 40 mounted adjacent to (e.g. shown as below) the drums 26 and 28. The light grid assemblies 40 include sensors 41 that are configured to either emit or receive one or more light beams 22. The light beams 22 are shown to run parallel to the centerline of the drum 26 or 28, extending the width of the drum 26 or 28. A plurality of light beams 22 are emitted from the light grid assemblies 40, forming a light grid covering the length of the drum 26 or 28. In exemplary embodiments, the light beams 22 are equally spaced approximately two inches apart, but other spacing may be used as appropriate for drum size, rope size, or other variables. The light beams 22 are located a predetermined distance away from the rope 16 or 18. In exemplary embodiments, the rope 16 or 18 is tightly wound around the drum 26 or 28, and the light beams 22 are located approximately two rope diameters (i.e. twice the length of the diameter of the rope 16 or 18) from the rope 16 or 18. The system 30 includes, or is configured to interface with, a control module (not shown). When one of the light beams 22 is broken (i.e. an obstruction such as a slack rope 24 or drooping rope 16 or 18 prevents the light beam 22 from reaching the light grid receiver), indicating that a slack rope condition is present, the control module is configured to respond. Any of a variety of responses (e.g. single, multiple, hierarchical, etc.) may be initiated. For example, the light grid system 30 may visually and/or audibly alert the operator that a slack rope condition is present, and/or the system 30 may automatically reduce the power output to the excavator 10, or the system 30 may respond in any other manner suitable to prevent damage to the excavator 10. The system 30 may also log the number of occurrences in relation to operating time and provide an alarm of an ongoing problem if a certain threshold of occurrences is reached.

Figure 4:
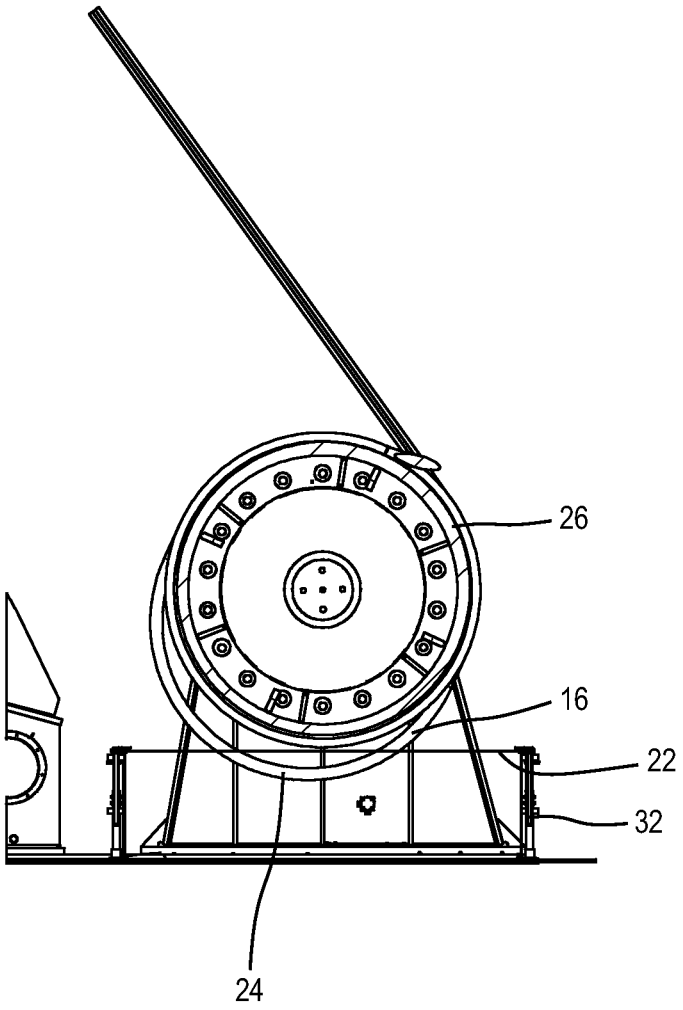
FIG. 4 is a cross-section view of a portion of the drum machinery, shown in the 4-4 direction according to FIG. 3.

Referring now to FIG. 4, a drum assembly slack rope condition is shown, according to an exemplary embodiment. In the illustrated embodiment of FIG. 4, a slack rope 24 is shown hanging below the light beams 22. In this embodiment, the light beams 22 are located a length of approximately two rope diameters away from the rope 16. The light beams 22 are configured to identify a slack rope 24. When one of the light beams 22 is broken by a slack rope 24, the light grid system 30 may respond in any manner suitable to prevent damage to the excavator 10. In exemplary embodiments, the control module may receive a signal from the light grid assemblies 40 when one or more light beams 22 are broken. The control module may then trigger a suitable response within the system 30 to prevent damage to the excavator 10. According to one embodiment, the system 30 and control module are integrated with the excavator 10 and the control module is associated with other controls of the excavator 10. In other embodiments, the system 30 may be retrofitted on the excavator 10 as an upgrade or service-related addition having a dedicated control module configured to interface with other control devices for the excavator 10.

Figure 6:
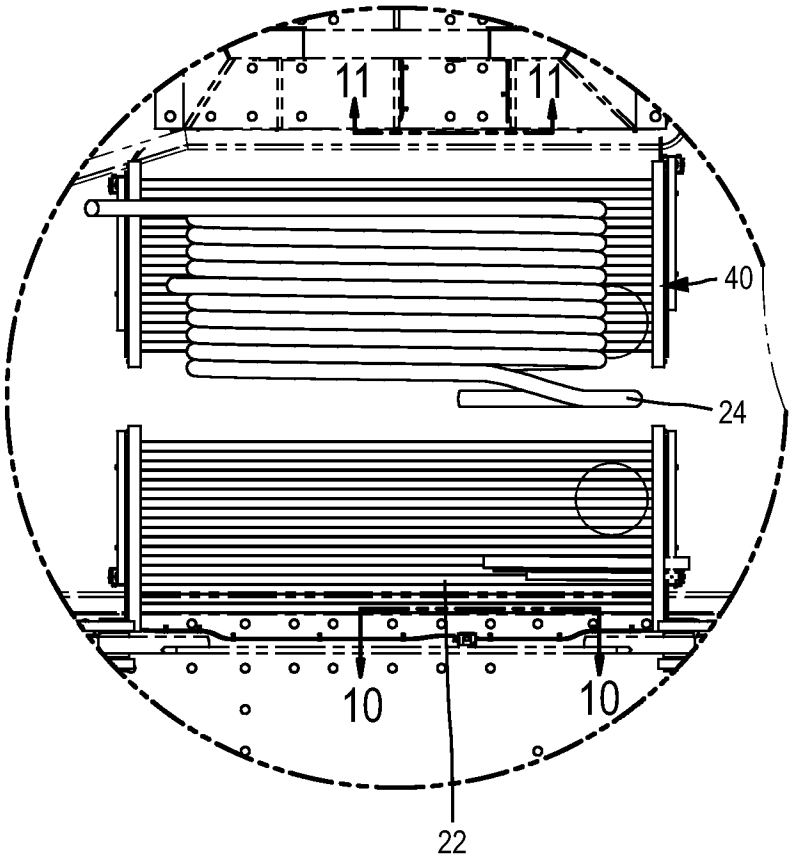
FIG. 6 is an isolated top view of the hoist drum machinery and through-beam light grid of FIG. 3, with the hoist drum removed for clarity.
Figure 5:
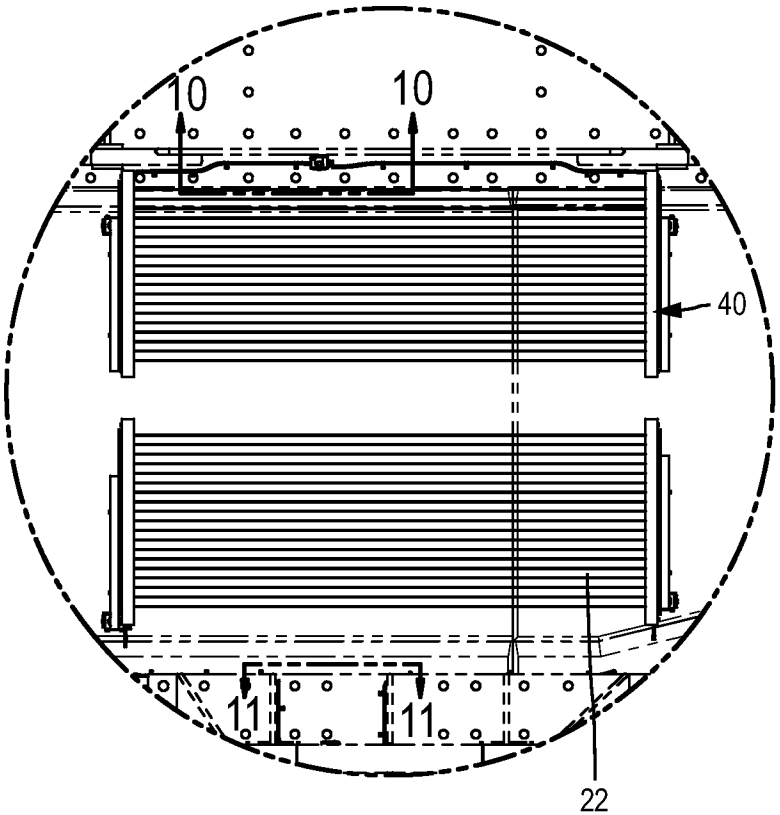
FIG. 5 is an isolated top view of the drag drum machinery and through-beam light grid of FIG. 3, with the drag drum removed for clarity.

Referring now to FIGS. 5 and 6, a top view of the light grid system 30 is shown, with the drums 26 and 28 removed for clarity. The light grid assemblies 40 are configured to transmit and/or receive light, creating the light beams 22. The light grid assemblies 40 are positioned so that assemblies 40 configured to emit light beams 22 are aligned with assemblies 40 configured to receive light beams 22. The light grid assemblies 40 send and receive a plurality of light beams 22 that form a light grid extending across the width of the drums 26 or 28. If the light beams 22 are broken by a slack rope 24 at either drum 26 or 28, the light grid assemblies 40 may be configured to send a signal representative of the slack condition to the control module, triggering an appropriate response associated with the condition on the applicable drum 26 or 28. The light grid assemblies 40 are shown in further detail in FIGS. 7 through 9.

Figure 7:
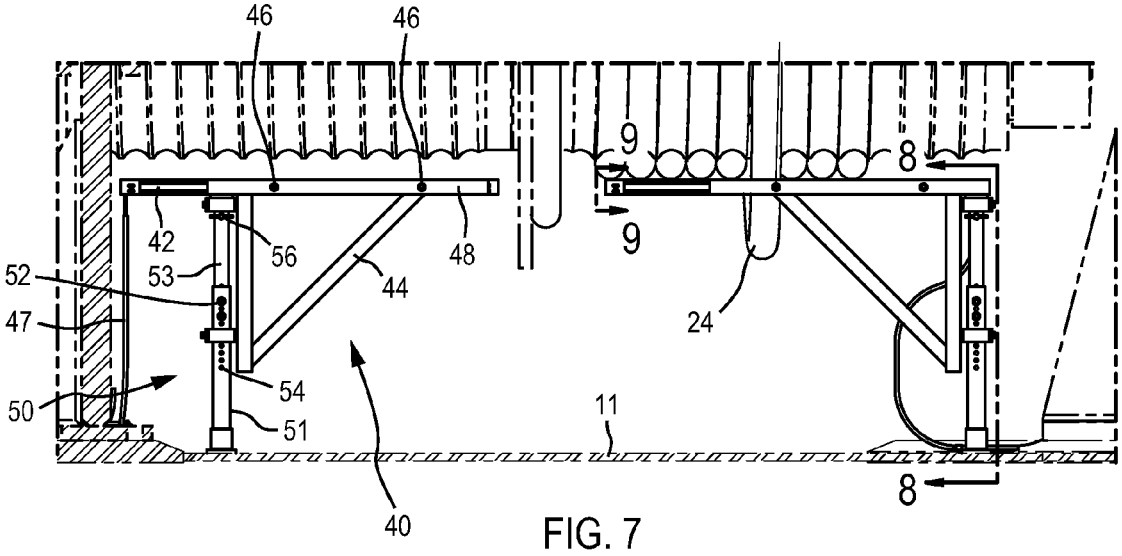
FIG. 7 is a cross-section view of a portion of the drum machinery, shown in the 7-7 direction according to FIG. 3.

Referring now to FIG. 7, a cross-section view of the drum assembly 25 of FIG. 3 is shown, in the 7-7 direction. According to the illustrated embodiment of FIG. 7, the light grid assembly 40 includes a sensor frame 48. The sensor frame 48 is shown positioned perpendicular to the center line of the drum 26 or 28, extending from the end of the drum 26 or 28 to approximately the center line of the drum 26 or 28. The sensor frame 48 is coupled perpendicularly to a post subassembly 50 (shown further in FIG. 8). The post subassembly 50 rests vertically (according to FIG. 7) on the top of the deck 11 (of excavator 10), providing support for the sensor frame 48. An arm subassembly 44 is coupled to both the sensor frame 48 and the post subassembly 50. The arm subassembly 44 includes two bars forming a triangle with the sensor frame 48. The arm subassembly 44 is intended to provide further support for the sensor frame 48 and the light grid assembly 40 generally.

The sensor frame 48 is also coupled to a sensor bracket 42. The sensor bracket 42 is coupled to one or more sensors 41 (shown in FIG. 9). As shown in the illustrated embodiment of FIG. 7, each sensor frame 48 extends from the end of the drum 26 or 28 up to the center line of the drum 26 or 28. The sensor brackets 42 are configured to translate along the sensor frames 48, adjusting the horizontal position of the sensors 41. In exemplary embodiments, the sensors 41 extend along the length of the sensor frame 48, thus covering the length of the drum 26 or 28.

The sensors 41 are configured to emit and/or receive light beams 22. In exemplary embodiments, a first set of sensor frames 48 is positioned on a first side of the drum 26 or 28, supporting one or more sensors 41 configured to emit a plurality of light beams 22. A second set of sensor frames 48 is aligned with the first set of sensor frames 48 and positioned on the other side of the drum 26 or 28. The second set of sensor frames 48 supports one or more sensors 41 configured to receive a plurality of light beams 22. In exemplary embodiments, the light beams 22 are equally spaced along the sensors 41, approximately two inches apart. The light grid system 30 is configured to send a signal to a control module when a light beam 22 is broken by an obstruction, such as when a slack rope condition is present.

Still referring to FIG. 7, the light grid assembly 40 includes at least two horizontal adjustment points 46 located on the sensor frame 48. The horizontal adjustment points 46 are intended to allow the sensor frame 48 and sensors 41 to be adjusted horizontally. The sensor bracket 42 includes a series of mating holes (or other suitable adjustment features) that are aligned with the horizontal adjustment points 46. The sensor frame 48 and sensor bracket 42 are then locked into place by locking hardware (not shown) inserted through the mating holes and the horizontal adjustment points 46. To adjust the sensor bracket 42 horizontally, the locking hardware is loosened and the sensor bracket 42 is slid left or right along the sensor frame 48 to achieve a desired sensor 41 alignment.

The light grid assembly 40 also includes two vertical adjustment points 52. The vertical adjustment points 52 are located on the post subassembly 50 and are intended to align the sensors 41 vertically. The post subassembly 50 includes a top post 53 and a bottom post 51. The top post 53 is positioned inside the bottom post 51 is configured to slide up or down within the bottom post 51 to position the sensors 41 vertically. The vertical adjustment points 52 are located on the top post 53, and are configured to align with vertical mating holes 54 located on the bottom post 51. Once the top post 53 has been positioned, locking hardware is inserted through the holes 54 and the points 52, locking the top post 53 in position relative to the bottom post 51. To adjust the grid assembly 40 vertically, the locking hardware is loosened and the top post 53 is translated up or down relative to the bottom post 51 to achieve a desired alignment, raising and lowering the height of the sensors 41.

Figure 8:
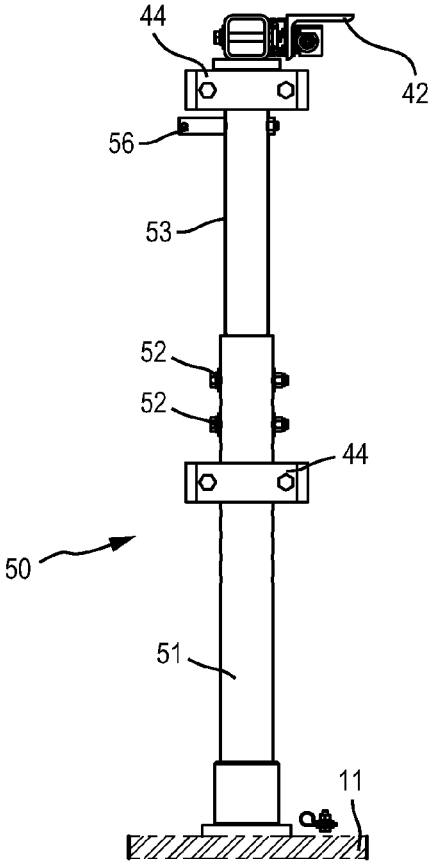
FIG. 8 is a cross-section view of a post subassembly for a light grid system, shown in the 8-8 direction according to FIG. 7.

Referring now to FIG. 8, the post subassembly 50 of FIG. 7 is shown, in the 8-8 direction. The post subassembly 50 includes a bottom post 51 configured to rest on the top of the deck 11 of the excavator 10. The arm subassembly 44 is coupled to the bottom post 51 and the top post 53, as shown in FIG. 8. The post subassembly 50 also includes a T-pin 56. In exemplary embodiments, the sensor frame 48 is configured to rotate in a plane perpendicular to the center line of the drum 26 or 28, and relative to the post subassembly 50. The T-pin 56 is intended to lock the sensor frame 48 in place relative to the post subassembly 50 once the light grid assembly 40 has been aligned, preventing the sensor frame 48 from rotating relative to the post subassembly 50. The T-pin 56 may be removed, however, allowing the sensor frame 48 to rotate in order to service the light grid assembly 40 or the drum assembly 25.

Figure 9:
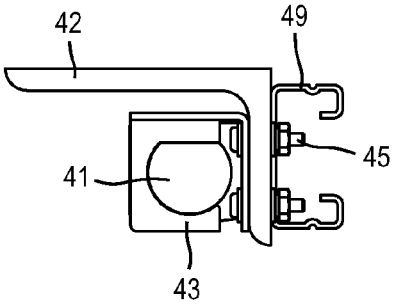
FIG. 9 is a side view of a light grid and sensor bracket, shown in the 9-9 direction according to FIG. 7.

Referring now to FIG. 9, a cross-section of the sensor bracket 42 of FIG. 7 is shown in the 9-9 direction. In exemplary embodiments, the sensor bracket 42 is coupled to the sensor frame 48 by a frame bracket 49. The frame bracket 49 is configured to attach to a portion of the sensor frame 48, connecting the sensor bracket 42 to the sensor frame 48. The sensor bracket 42 is also coupled to a mounting bracket 43 by a locking assembly 45. In the illustrated embodiment of FIG. 9, the locking assembly 45 includes at least a bolt, a washer, and a nut, but the locking assembly 45 may include any other locking hardware in other embodiments. The mounting bracket 43 is connected to the sensor 41, which emits and/or receives light beams 22.

Figure 10:
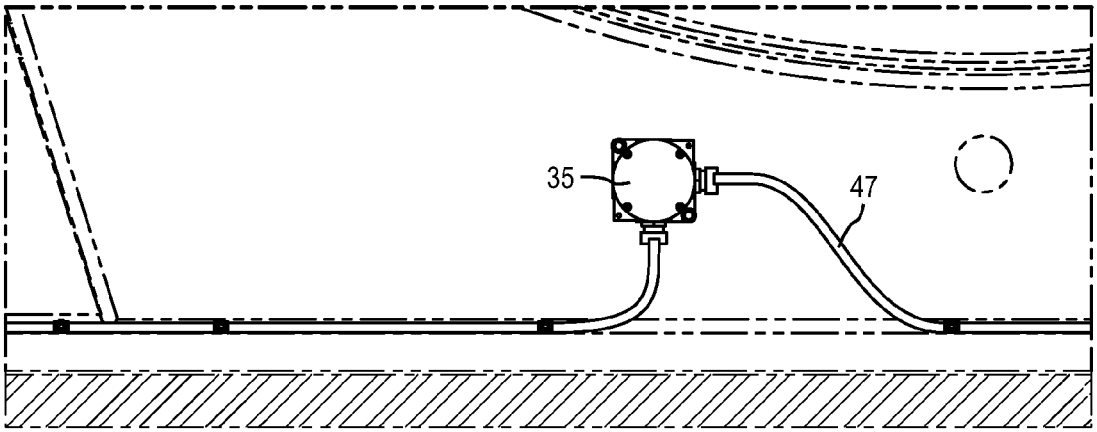
FIG. 10 is a cross-section of a junction box to gear case installation, shown in the 10-10 direction according to FIG. 6.
Figure 11:
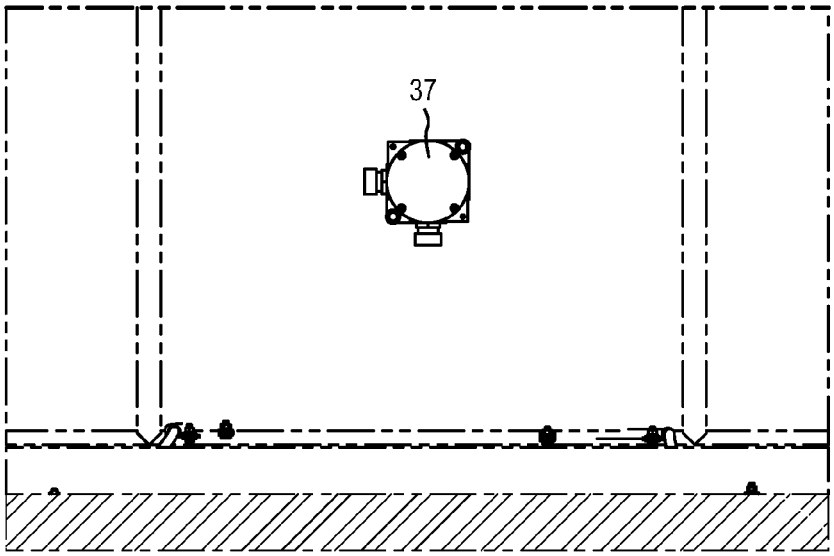
FIG. 11 is a cross-section of a junction box to gear case installation, shown in the 11-11 direction according to FIG. 5.

Referring now to FIGS. 10 and 11, cross-sections of the light grid system 30 are shown, according to an exemplary embodiment. In FIG. 10, a cross-section of FIG. 6 is shown in the 10-10 direction. In FIG. 11 a cross-section of FIG. 5 is shown in the 11-direction. FIG. 10 shows a view of a junction box 35 and FIG. 11 shows a view of a junction box 37. The junction box 35 or 37 is a small metal or plastic box that is intended to house electrical connections. In the illustrated embodiment of FIGS. 10 and 11, the sensor wire 47 runs from the light grid assembly 40 to the junction box 35 or 37, and then to a PLC or other control module. The PLC or other control module may receive a signal from the light grid assembly 40, interpret that signal, and cause the light grid system 30 to respond. The light grid system 30 may alert the operator that a slack rope condition is present, the system 30 may automatically power down the excavator 10, or the system 30 may respond in any other manner suitable to prevent damage to the excavator 10.

The construction and arrangements of the light grid system, as shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

INDUSTRIAL APPLICABILITY

The disclosed light grid system may be implemented into any rope machinery, including dragline excavators and rope shovels. The disclosed light grid system may identify a slack rope condition more quickly than conventional slack rope detection modules by utilizing multiple light grids and by resting in a position closer to the rope drums. By detecting the slack rope condition more quickly, the disclosed light grid system will prevent damage to machine components. The disclosed light grid system may also reduce the number of false slack rope condition readings by allowing an operator or technician to make adjustments to the position of the light grids, thus reducing machine downtime.

It will be apparent to those skilled in the art that various modifications and variations can be made to the disclosed light grid system. Other embodiments will be apparent to those skilled in the art from consideration of the specification and practice of the disclosed light grid system. It is intended that the specification and examples be considered as exemplary only, with a true scope being indicated by the following claims and their equivalents.

What is claimed is:

1. A light grid system for rope machinery, the rope machinery including a rope drum having a center line, and a rope wrapped around the rope drum, the rope configured to maneuver a machinery component, the light grid system comprising:

one or more light grid assemblies, comprising:

sensor frames coupled substantially perpendicularly to one or more vertical post assemblies, wherein the sensor frames are configured to mount substantially parallel to the axis of rotation of the rope drum and extending along the length of the rope drum; and sensors coupled to and positioned along the length of the sensor frames, the sensor frames including at least a first sensor frame having sensors configured to emit one or more light beams, and at least a second sensor frame having sensors configured to receive the one or more light beams, such that the one or more light beams are configured to extend across the width of the rope drum and in a plane substantially perpendicular to the axis of rotation of the rope drum, and wherein the sensors are adjustable relative to the sensor frames to move the one or more light beams horizontally relative to the rope drum and in a direction parallel to the axis of rotation of the rope drum;

wherein the one or more light beams are positionable a predetermined distance away from the rope; and wherein the one or more light grid assemblies are configured to transmit a signal to a control module associated with the rope machinery when at least one of the one or more light beams is obstructed.

2. The light grid system of claim 1, the one or more vertical post assemblies each further comprising a top post coupled to a bottom post, the top post configured to move up or down relative to the bottom post, raising and lowering the height of the sensors.

3. The light grid system of claim 2, further comprising one or more vertical adjustment points located on the top post and configured to align with one or more vertical mating holes located on the bottom post, and locking hardware configured to mate with the one or more vertical adjustment points and the one or more vertical mating holes, locking the top post relative to the bottom post.

4. The light grid system of claim 1, the one or more light grid assemblies further comprising sensor brackets coupling the sensors to the sensor frames and configured to translate left or right along the sensor frames, adjusting the sensors horizontally and in a direction parallel to the axis of rotation of the rope drum.

5. The light grid system of claim 4, further comprising one or more horizontal mating holes located on the sensor brackets and configured to align with one or more horizontal adjustment points located on the sensor frames, and locking hardware configured to mate with the one or more horizontal adjustment points and the one or more horizontal mating holes, locking the sensor brackets relative to the sensor frames.

6. The light grid system of claim 1, wherein the predetermined distance is twice the diameter of the rope, and wherein the one or more light grid assemblies are vertically adjustable to move the one or more light beams to the predetermined distance based on the diameter of the rope.

7. The light grid system of claim 1, wherein the sensor frames are configured to rotate relative to the one or more vertical post assemblies and away from the rope drum, in a plane perpendicular to the one or more vertical post assemblies.

8. The light grid system of claim 7, further comprising one or more removable pins configured to couple each of the sensor frames and the one or more vertical post assemblies, preventing the sensor frames from rotating relative to the one or more vertical post assemblies.

9. The light grid system of claim 1, wherein the control module is configured to transmit an operator alert upon receiving the signal.

10. The light grid system of claim 1, wherein the control module reduces power to the rope machinery when the signal is received.

11. A dragline excavator, comprising:

a bucket assembly;

a rope drum having a center line;

a rope wrapped around the rope drum, the rope configured to maneuver the bucket assembly; and one or more light grid assemblies, comprising:

sensor frames coupled substantially perpendicularly to one or more vertical post assemblies, the sensor frames mounted substantially parallel to the axis of rotation of the rope drum and extending along the length of the rope drum; and sensors coupled to and positioned along the length of the sensor frames, the sensor frames including at least a first sensor frame having sensors configured to emit one or more light beams, and at least a second sensor frame having sensors configured to receive the one or more light beams, such that the one or more light beams are configured to extend across the width of the rope drum and in a plane substantially perpendicular to the axis of rotation of the rope drum, and wherein the sensors are adjustable relative to the sensor frames to move the one or more light beams horizontally relative to the rope drum and in a direction parallel to the axis of rotation of the rope drum;

wherein the one or more light beams are positionable a predetermined distance away from the rope; and wherein the one or more light grid assemblies are configured to transmit a signal to a control module associated with the dragline excavator when at least one of the one or more light beams is obstructed.

12. The dragline excavator of claim 11, the one or more vertical post assemblies each further comprising a top post coupled to a bottom post, the top post configured to move up or down relative to the bottom post, raising and lowering the height of the sensors.

13. The dragline excavator of claim 12, further comprising one or more vertical adjustment points located on the top post and configured to align with one or more vertical mating holes located on the bottom post, and locking hardware configured to mate with the one or more vertical adjustment points and the one or more vertical mating holes, locking the top post relative to the bottom post.

14. The dragline excavator of claim 11, the one or more light grid assemblies further comprising sensor brackets coupling the sensors to the sensor frames and configured to translate left or right along the sensor frames, adjusting the sensors horizontally and in a direction parallel to the axis of rotation of the rope drum.

15. The dragline excavator of claim 14, further comprising one or more horizontal mating holes located on the sensor brackets and configured to align with one or more horizontal adjustment points located on the sensor frames, and locking hardware configured to mate with the one or more horizontal adjustment points and the one or more horizontal mating holes, locking the sensor brackets relative to the sensor frames.

16. The dragline excavator of claim 11, wherein the sensor frames are configured to rotate relative to the one or more vertical post assemblies and away from the rope drum, in a plane perpendicular to the one or more vertical post assemblies.

17. The dragline excavator of claim 16, further comprising one or more removable pins configured to couple the sensor frames and the one or more vertical post assemblies, preventing the sensor frames from rotating relative to the one or more vertical post assemblies.

18. The dragline excavator of claim 11, wherein the control module is configured to transmit an operator alert upon receiving the signal.

19. A method for installing a light grid system for rope machinery, the method comprising:

providing a first light grid assembly having sensors configured to emit a plurality of light beams;

providing a second light grid assembly having sensors configured to receive the plurality of light beams from the sensors of the first light grid assembly;

positioning the first light grid assembly and the second light grid assembly to provide a light grid at a predetermined distance in relation to a rope drum, wherein each of the light grid assemblies includes a sensor frame coupled substantially perpendicularly to a substantially vertical post assembly, positioned substantially parallel to the axis of rotation of the rope drum, and extending along the length of the rope drum, wherein the light grid extends across the width of the rope drum and in a plane substantially perpendicular to the axis of rotation of the rope drum, and wherein the sensors are adjustable relative to the sensor frames to move the light grid horizontally relative to the rope drum and in a direction parallel to the axis of rotation of the rope drum; and providing a control module configured to initiate a response when one or more of the plurality of light beams are obstructed.

20. The method of claim 19, further comprising alerting an operator upon receiving a signal from the control module.

* * * * *